US008740299B1

(12) United States Patent
Hall

(10) Patent No.: US 8,740,299 B1
(45) Date of Patent: Jun. 3, 2014

(54) MULTIPURPOSE TABLE

(71) Applicant: Joseph D. Hall, Kill Devil Hills, NC (US)

(72) Inventor: Joseph D. Hall, Kill Devil Hills, NC (US)

( * ) Notice: Subject to any disclaimer, the term of this patent is extended or adjusted under 35 U.S.C. 154(b) by 0 days.

(21) Appl. No.: 13/922,025

(22) Filed: Jun. 19, 2013

(51) Int. Cl.
*A47B 3/06* (2006.01)

(52) U.S. Cl.
USPC ..... 297/158.5; 297/135

(58) Field of Classification Search
USPC ..... 297/135, 150, 154, 157.1, 158.5, 159, 297/139, 158.2, 173, 156; 108/162
See application file for complete search history.

(56) References Cited

U.S. PATENT DOCUMENTS

| | | | | | |
|---|---|---|---|---|---|
| 828,079 | A | * | 8/1906 | Williamson | 297/156 |
| 2,109,869 | A | * | 3/1938 | Ross | 297/143 |
| 2,215,657 | A | * | 9/1940 | Anderson | 297/156 |
| 2,522,774 | A | * | 9/1950 | Bower | 297/139 |
| D211,796 | S | | 7/1968 | Conklin | |
| 3,765,719 | A | * | 10/1973 | Silver | 297/170 |
| D279,433 | S | | 7/1985 | Fuchs | |
| D282,608 | S | | 2/1986 | Crowe | |
| D323,074 | S | | 1/1992 | Michel | |
| 5,367,964 | A | * | 11/1994 | Hockensmith | 108/180 |
| D360,536 | S | | 7/1995 | Pelletier | |
| 5,720,512 | A | * | 2/1998 | Hostetler | 297/158.5 |
| 5,865,501 | A | * | 2/1999 | Eisenberg et al. | 297/158.5 |
| D409,008 | S | | 5/1999 | Lunn | |
| D416,693 | S | | 11/1999 | Kovalchek | |
| 6,007,147 | A | * | 12/1999 | McCracken | 297/158.5 |
| D497,263 | S | | 10/2004 | Darling | |
| D573,360 | S | | 7/2008 | Bue et al. | |

* cited by examiner

*Primary Examiner* — Jose V Chen
(74) *Attorney, Agent, or Firm* — Ward and Smith, P.A.

(57) ABSTRACT

A multipurpose table and methods of configuring the same is disclosed. The multipurpose table includes a base, or optionally a surface, a pair of tabletop supports, a tabletop assembly, and a plurality of seats. The seats can be arranged outwardly from the tabletop assembly to provide a "table mode" of operation or arranged inwardly toward the tabletop assembly to provide a "bar mode" of operation. Further, some seats can be arranged outwardly from the tabletop assembly while at the same time other seats are arranged inwardly toward the tabletop assembly. Further, the tabletop assembly includes a pair of drop leaves that can be opened or closed at the user's discretion.

19 Claims, 17 Drawing Sheets

MULTIPURPOSE TABLE

TECHNICAL FIELD

The presently disclosed subject matter relates generally to tables for outdoor or indoor use and more particularly to a multipurpose table and methods of configuring the same.

BACKGROUND

Many types of multipurpose tables can be found in a variety of public and private places, such as backyards, parks, campgrounds, rest stops, restaurants, and the like. Multipurpose tables known in the art, however, are often large and bulky structures that have a fixed footprint and size. Consequently, such multipurpose tables typically require a relatively large area for use and are not suitable for use in confined areas including, but not limited to, a small room, a deck, a patio, or a balcony. Further, conventional multipurpose tables are not very versatile. For example, most multipurpose tables are commonly configured for use as an eating table with a tabletop and fixed benches along the sides of the tabletop for seating. Such configurations typically are not adjustable. Therefore, the amount of space that the table takes up cannot be reduced if desired.

SUMMARY

In some aspects, the presently disclosed subject matter comprises a multipurpose table and methods of use thereof, the multipurpose table comprising:

a base, or optionally a surface, such as a deck surface, comprising one or more openings configured to receive one or more seat supports, wherein the one or more openings has a cross-sectional dimension greater than a cross-sectional dimension of the one or more seat supports, and wherein each seat support comprises a first end and a second end, wherein the first end has a seat top affixed thereto and the second end is adapted to fit into an opening in the base, and wherein each seat support has a first notch and a second notch positioned toward the second end thereof, wherein the first notch is configured to be engaged with an outside surface of the base and the second notch is configured to be engaged with an inside surface of the base to securely hold the seat support in a predetermined position;

a tabletop assembly comprising a center panel having at least two opposing sides, wherein at least one opposing side has a drop leaf foldably coupled thereto; and at least one tabletop support, wherein the at least one tabletop support is mechanically coupled at one end to an upper surface of the base and at an opposite end to a lower surface of the tabletop, and wherein the at least one tabletop support further comprises a set of drop leaf supports foldably coupled thereto and configured to hold a drop leaf in an open position when the drop leaf support is folded away from the tabletop support and configured to be retracted when the drop leaf is in a closed position.

Certain aspects of the presently disclosed subject matter having been stated hereinabove, which are addressed in whole or in part by the presently disclosed subject matter, other aspects will become evident as the description proceeds when taken in connection with the accompanying Examples and Drawings as best described herein below.

BRIEF DESCRIPTION OF THE DRAWINGS

Figure 1:
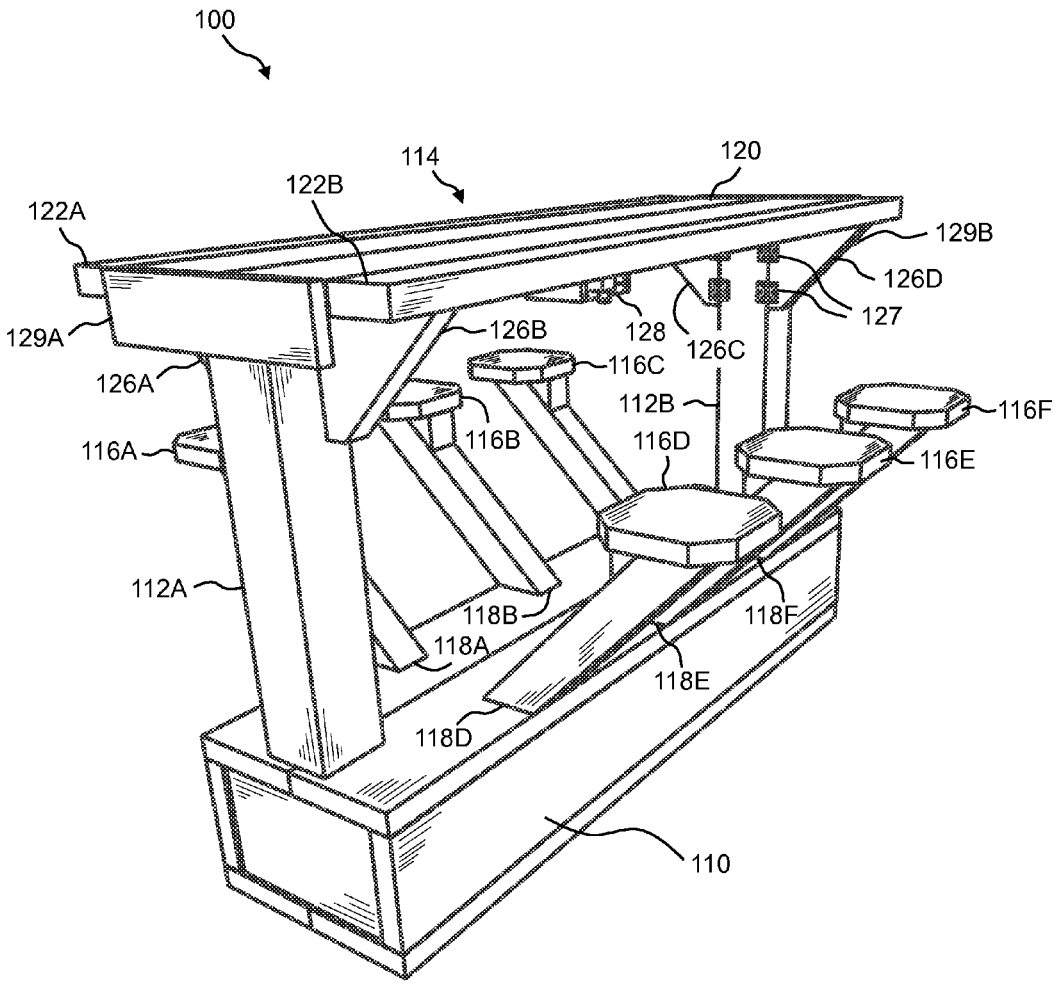
Figure 2:
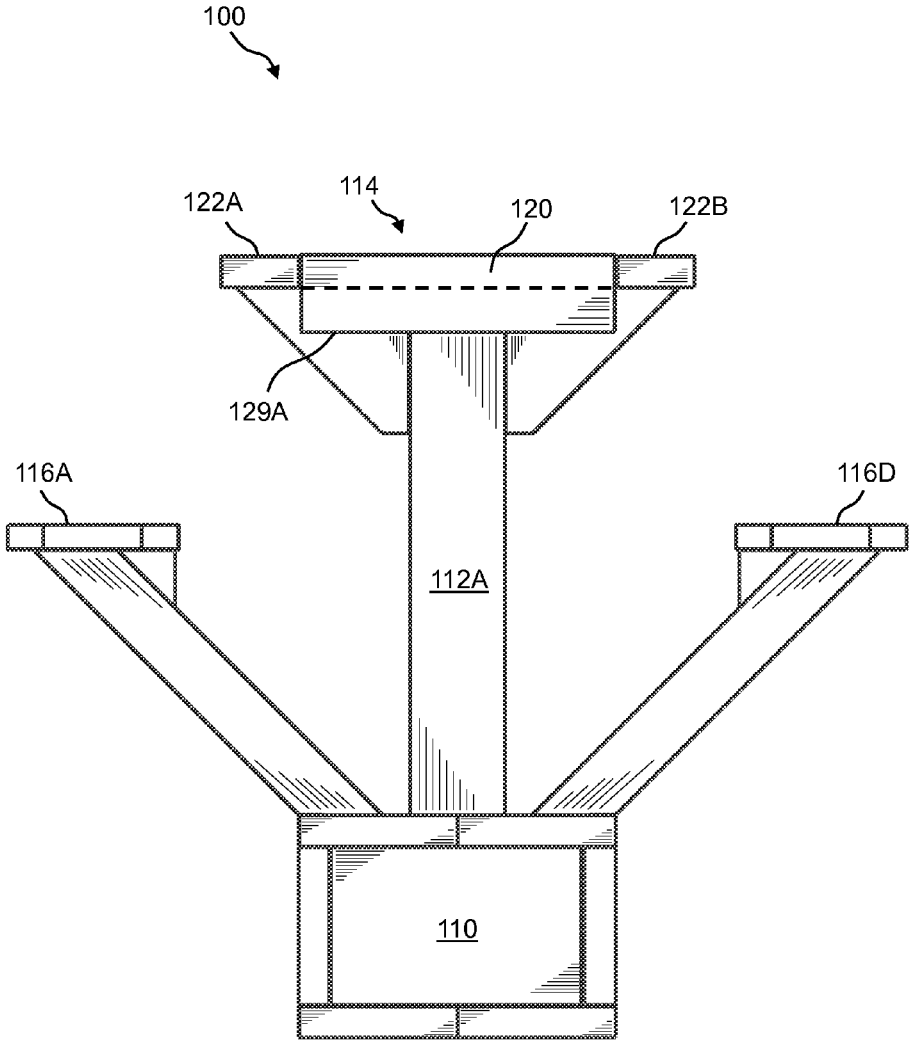
Figure 3:
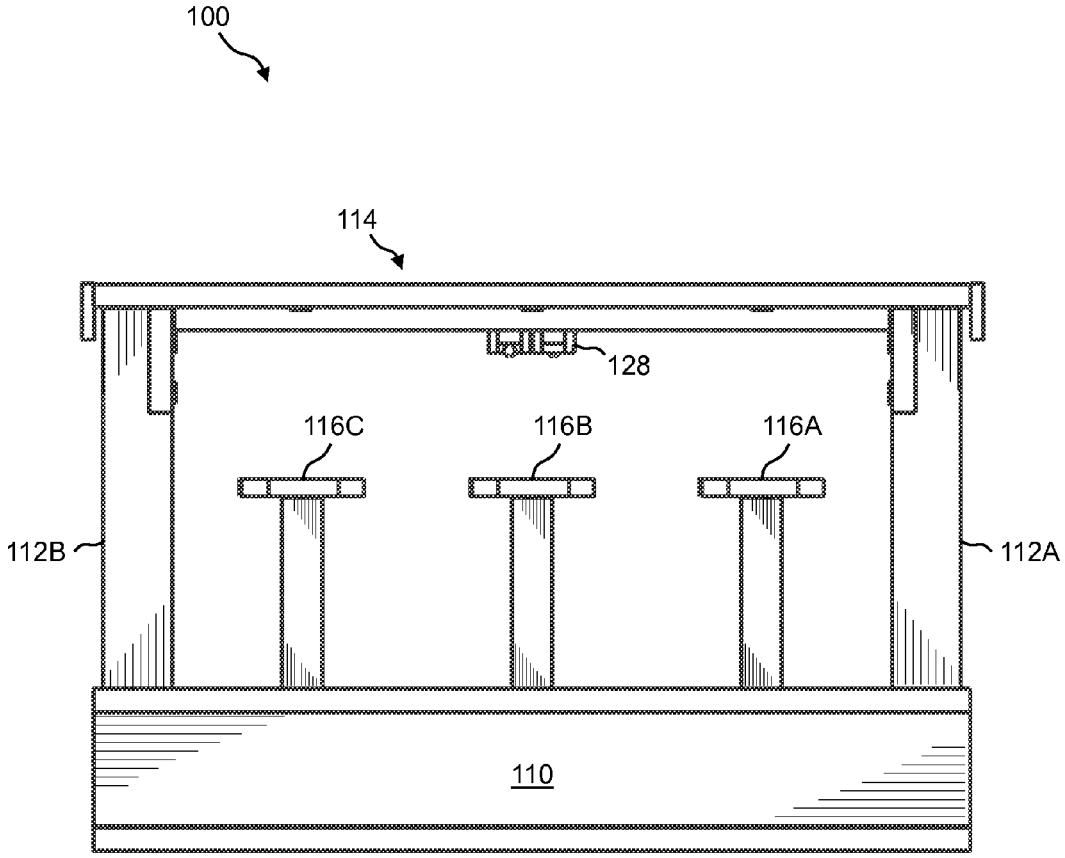
Figure 4:
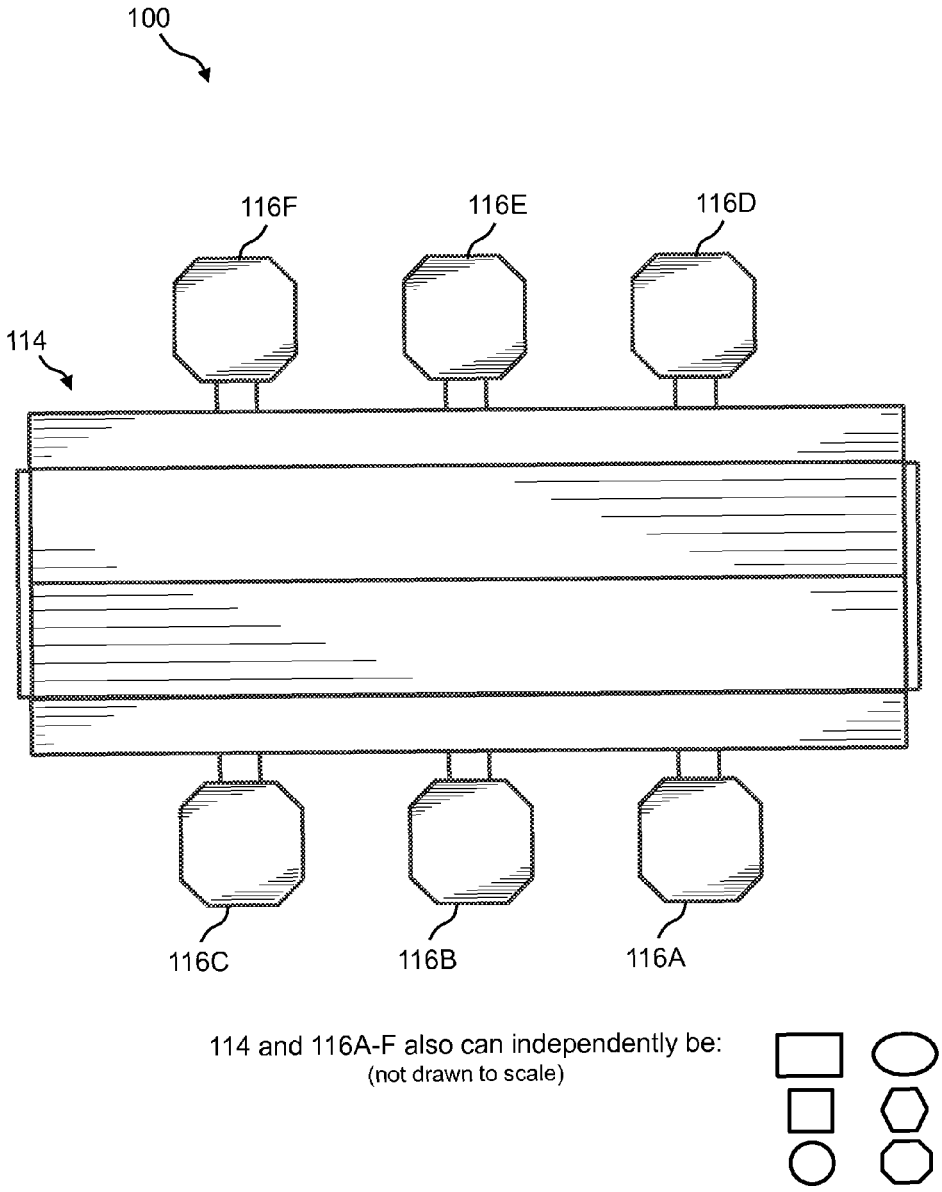
Figure 5:
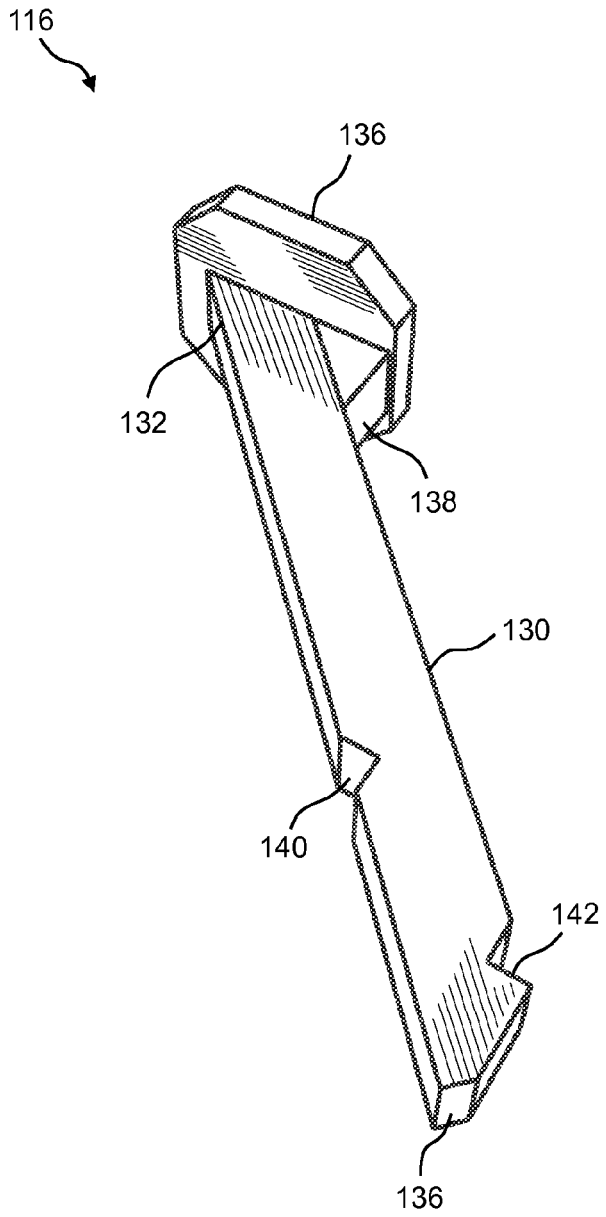
Figure 6:
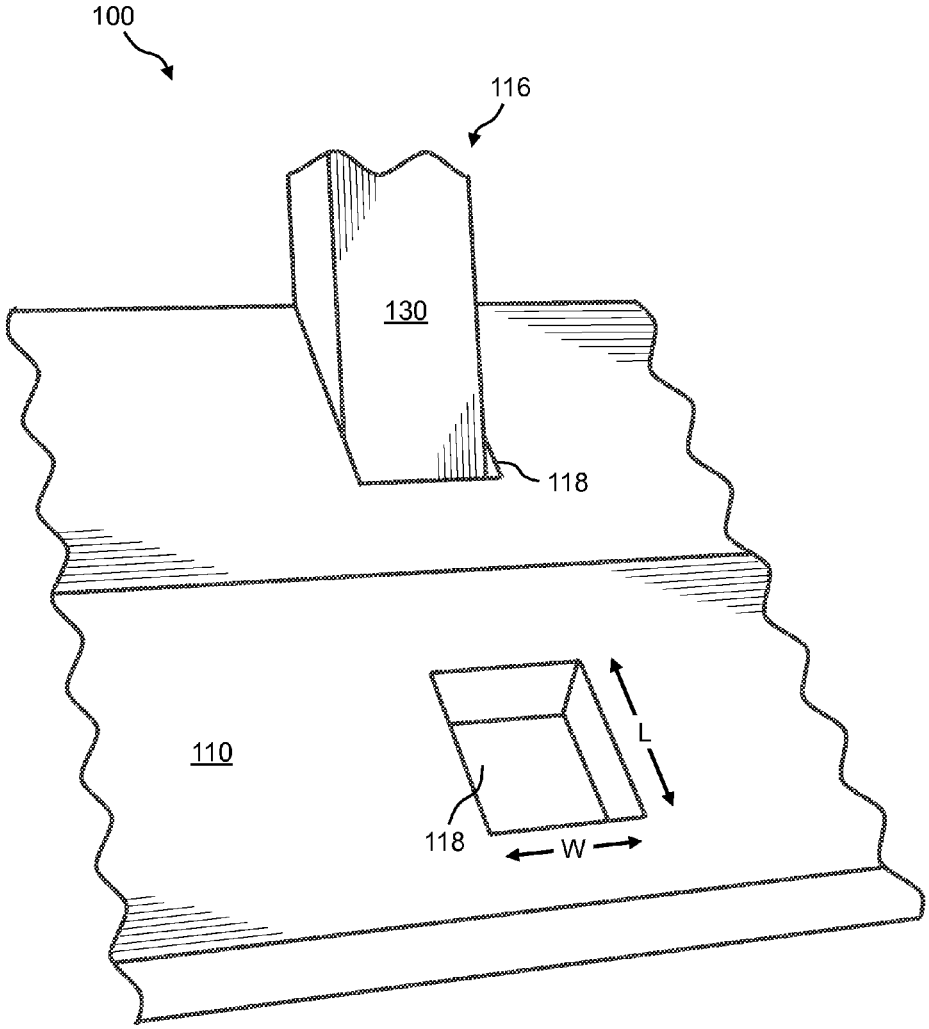
Figure 7:
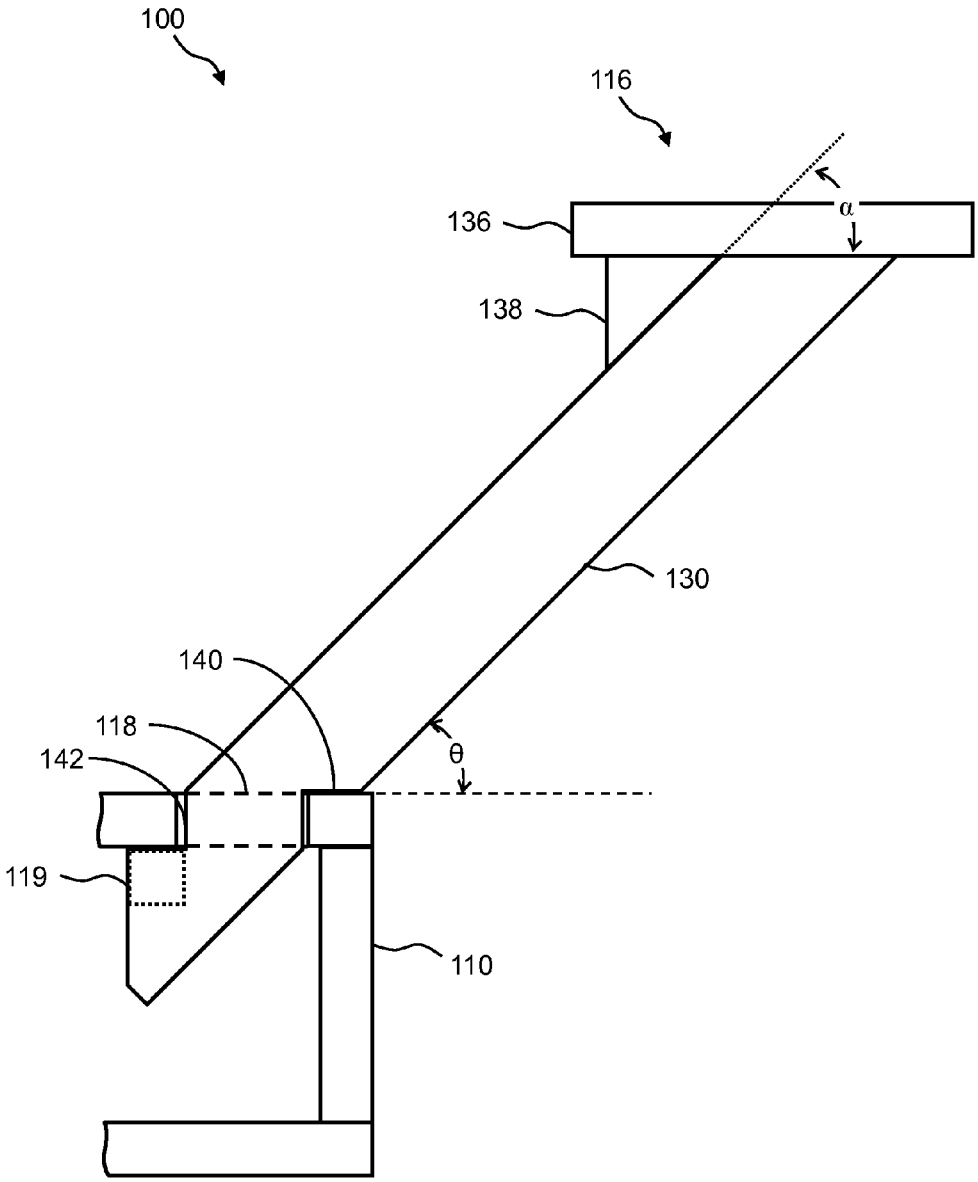
Figure 8:
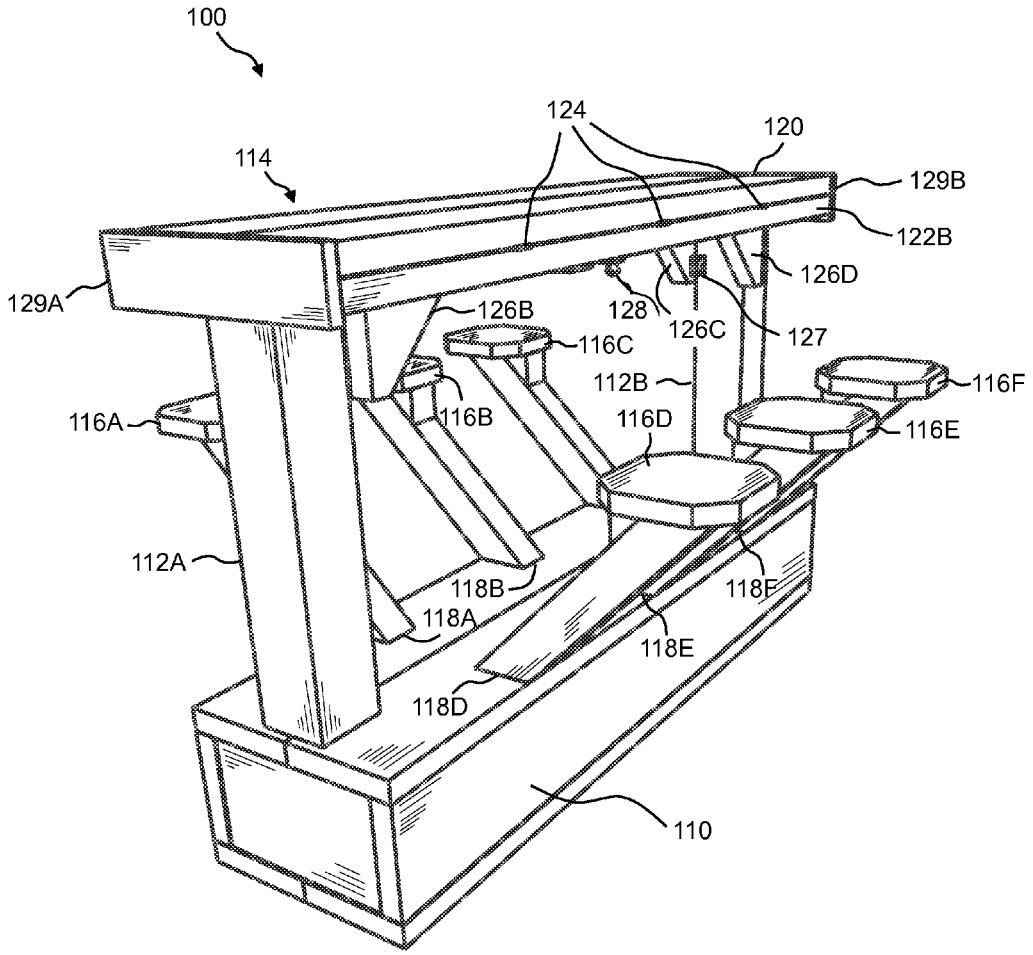
Figure 9:
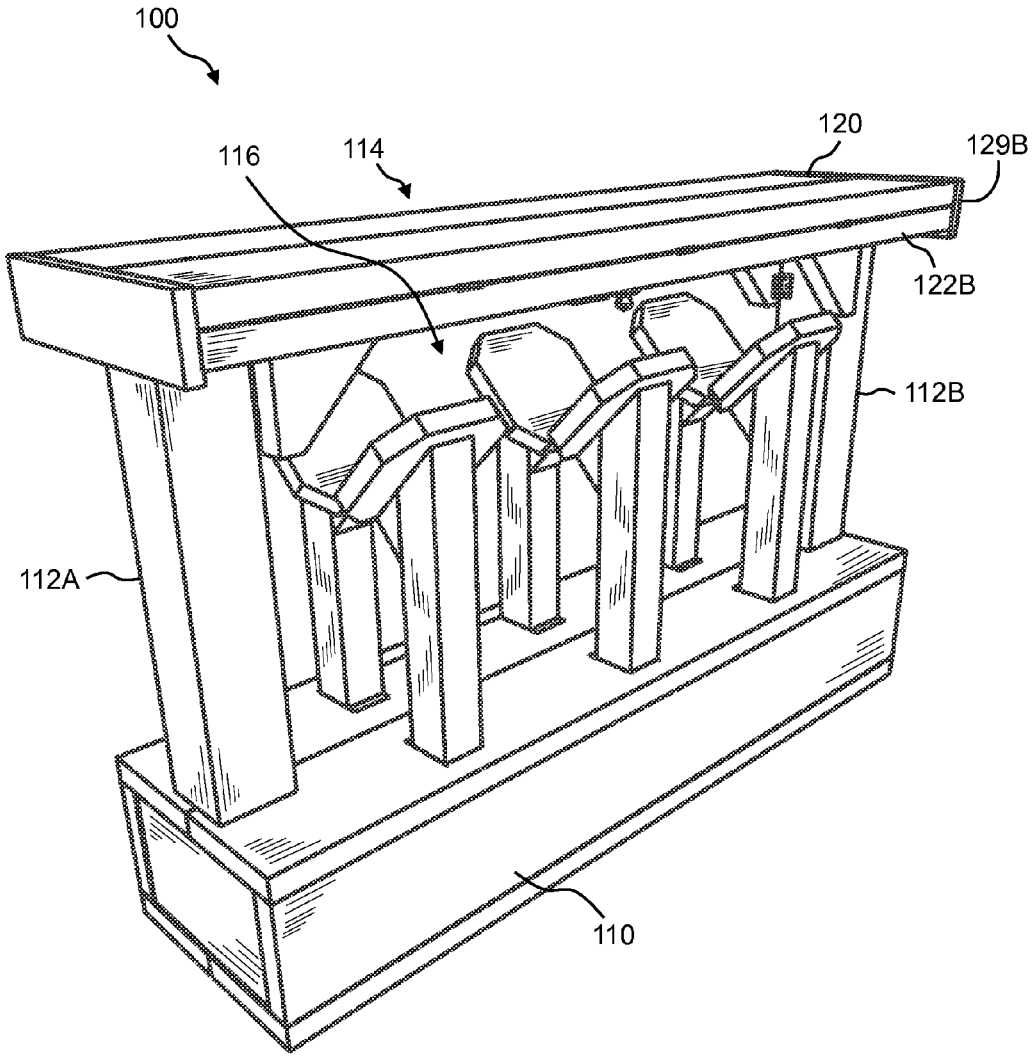
Figure 10:
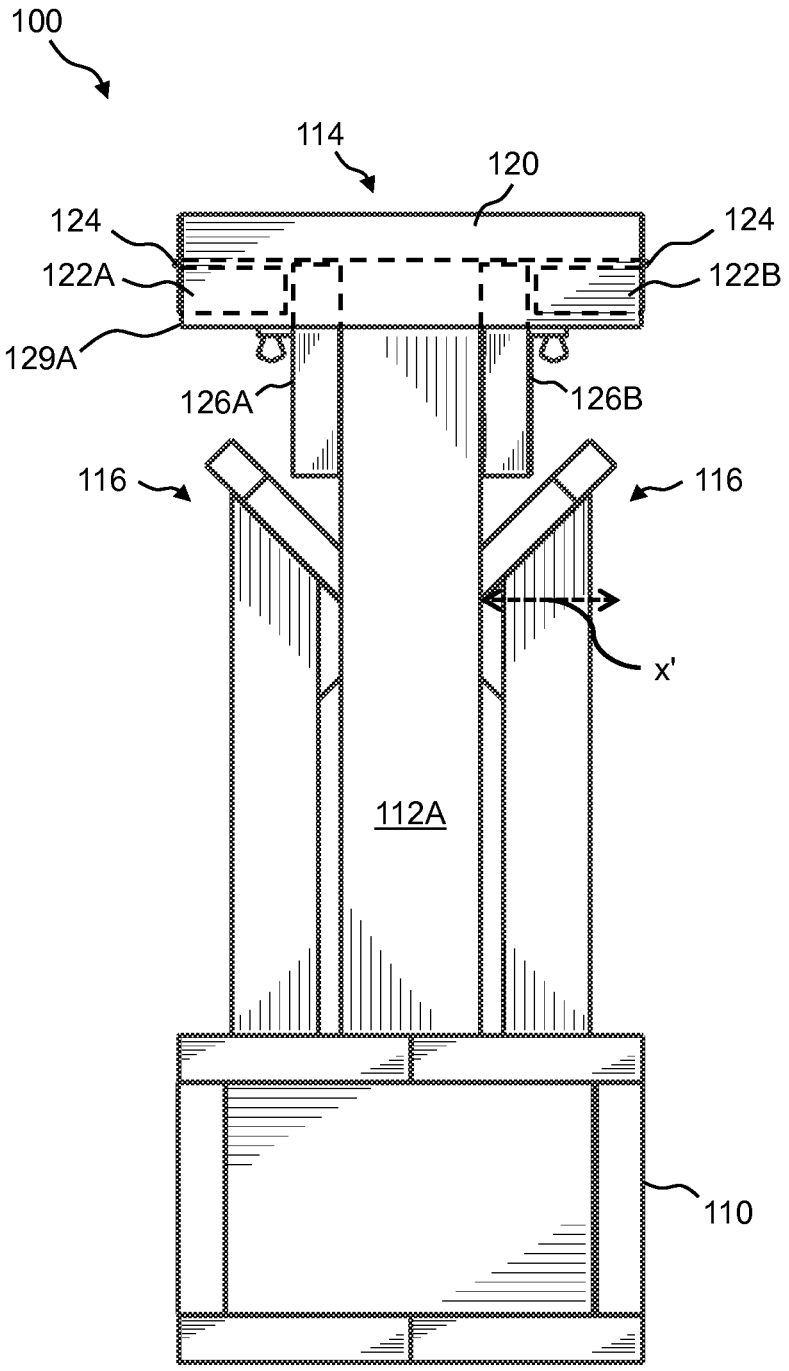
Figure 11:
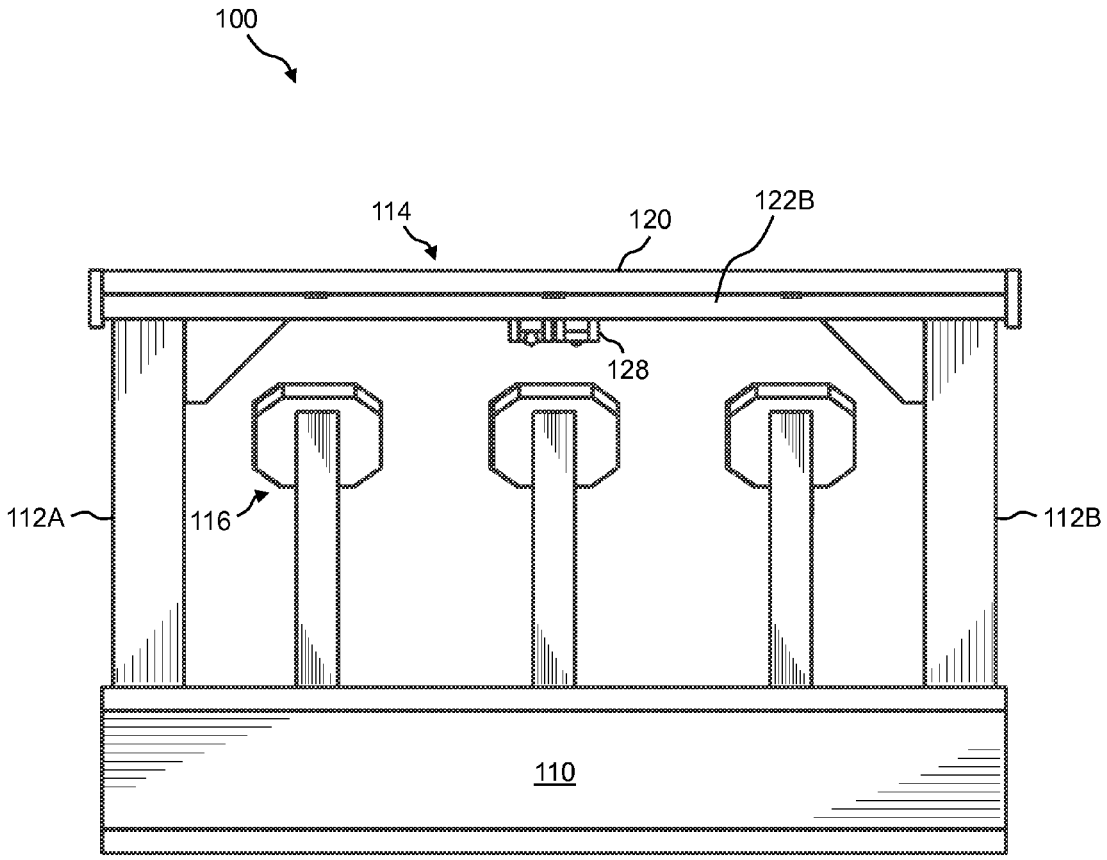
Figure 12:
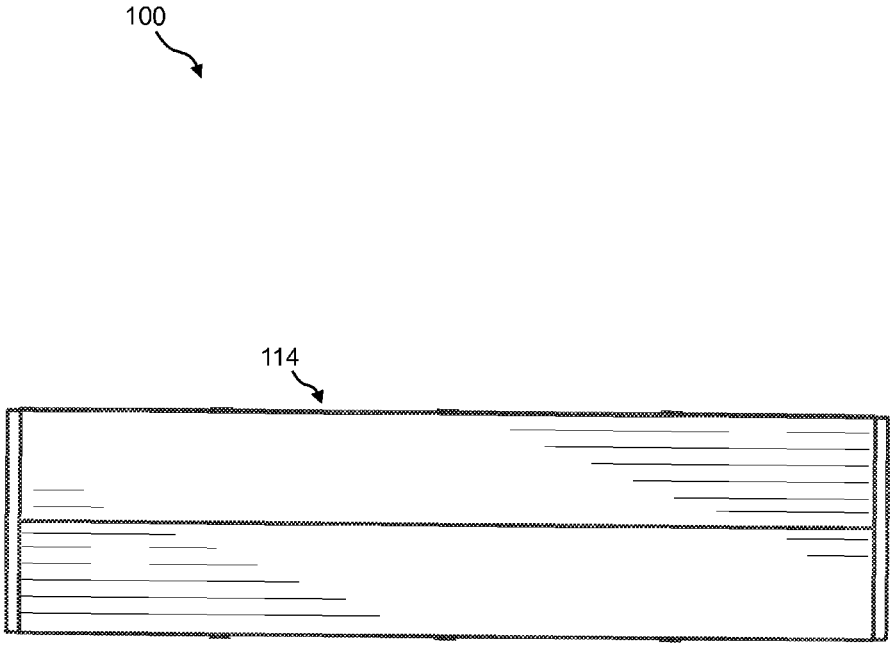
Figure 13:
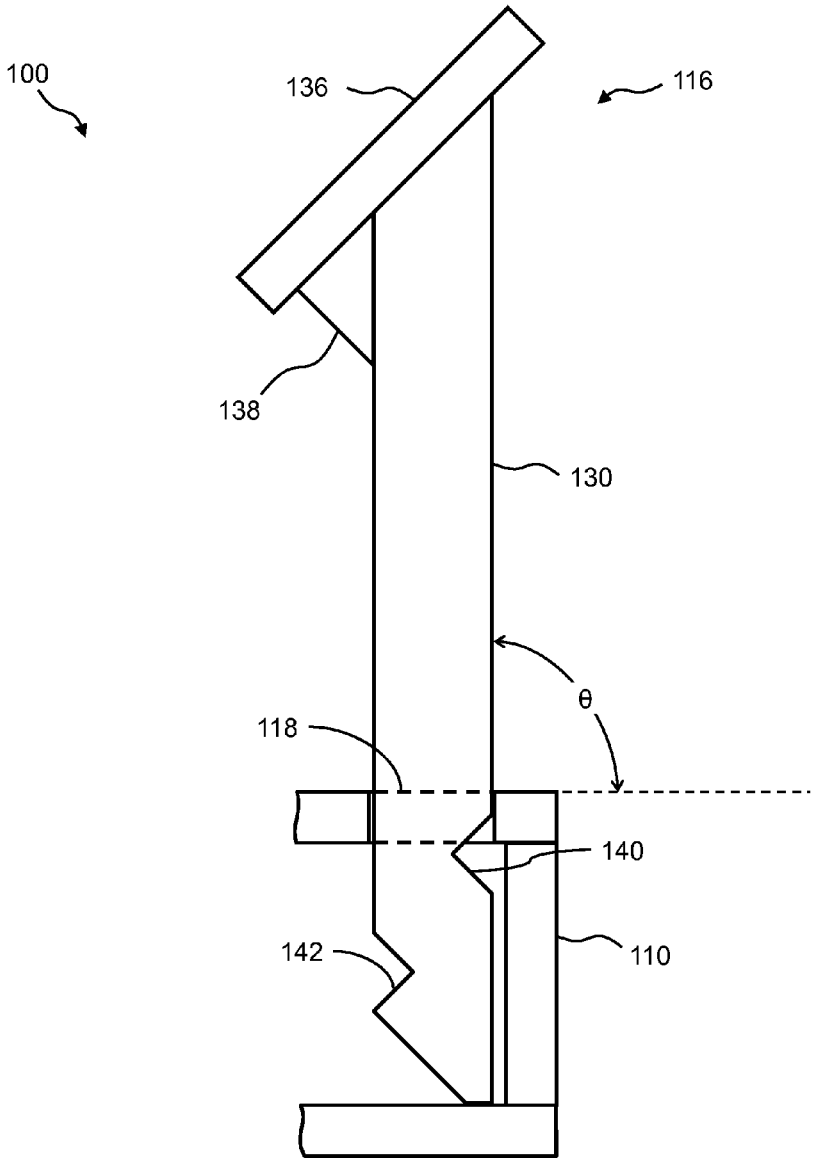
Figure 14:
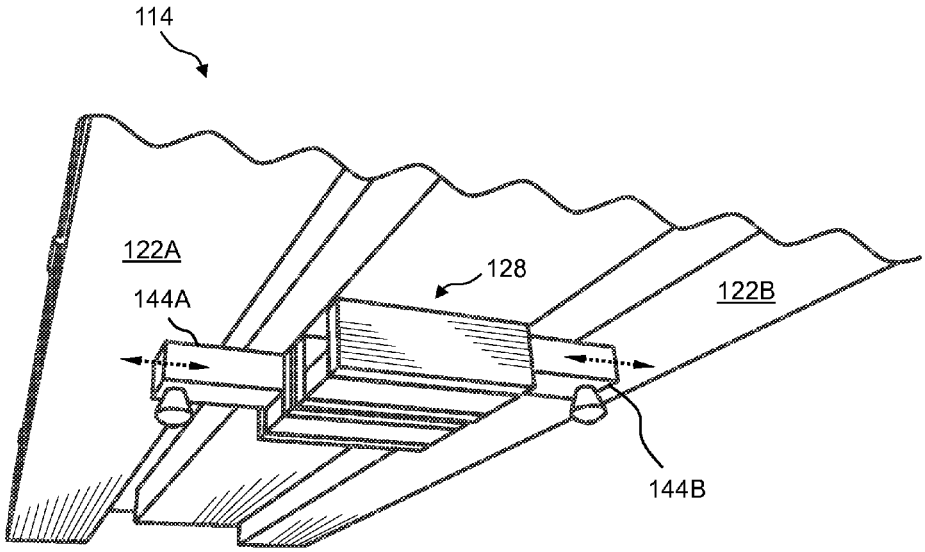
Figure 15:
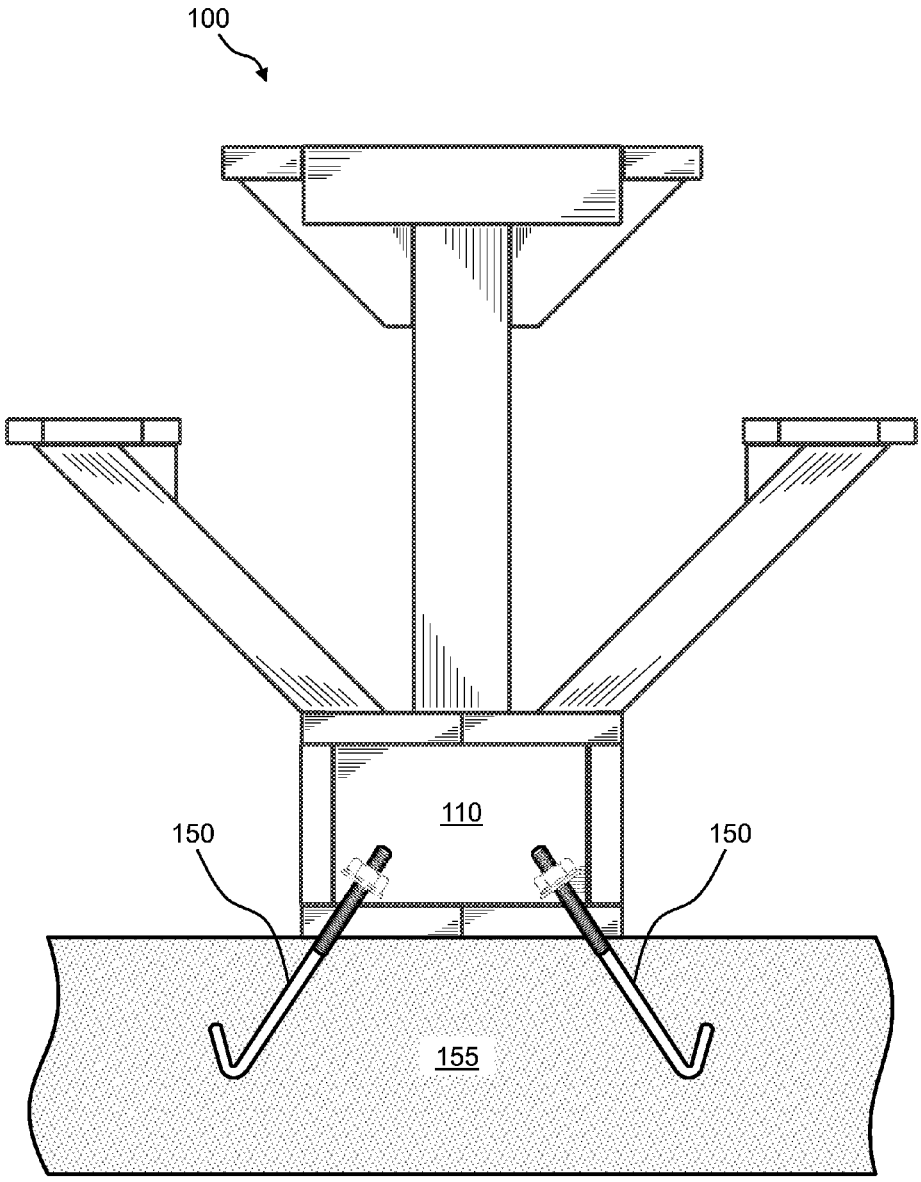
Figure 16:
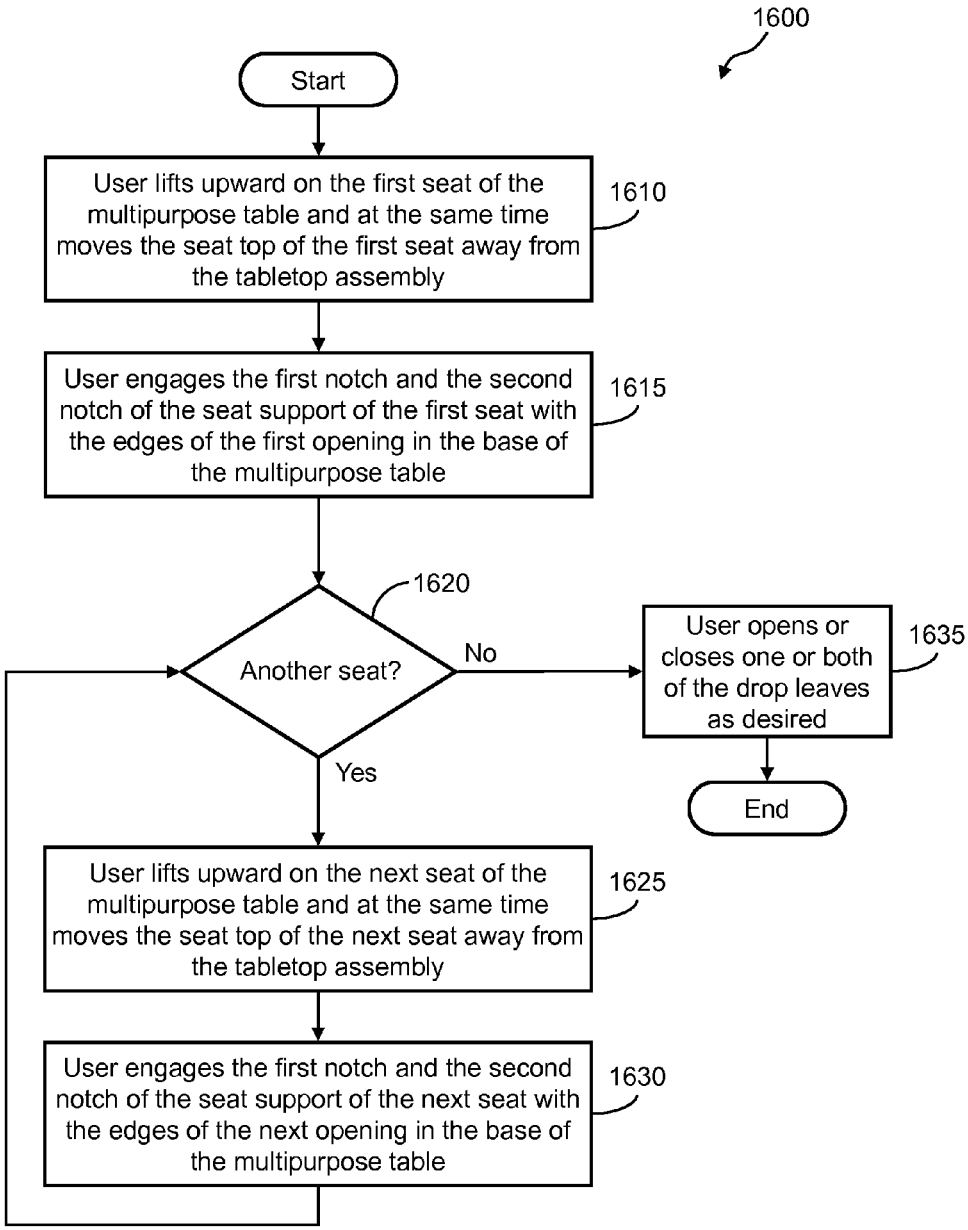
Figure 17:
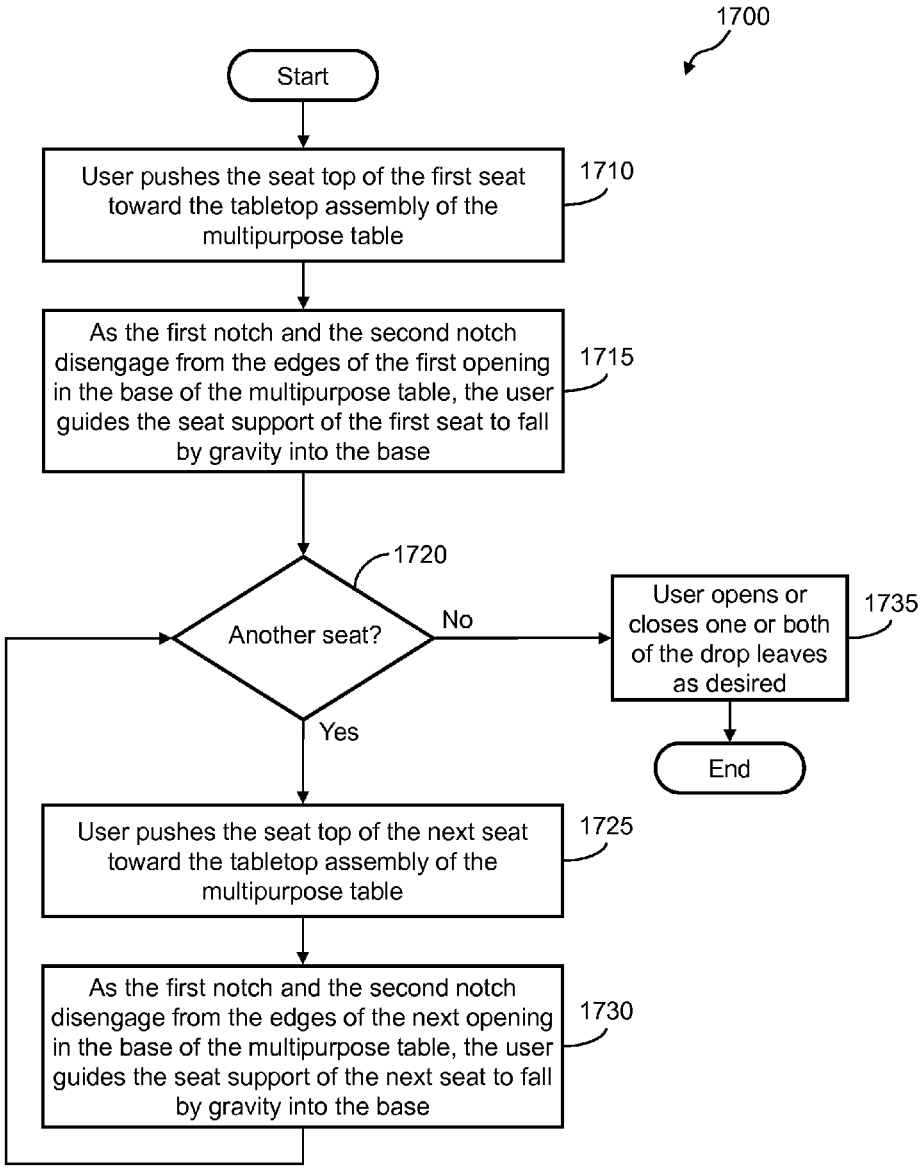

Having thus described the presently disclosed subject matter in general terms, reference will now be made to the accompanying Drawings, which are not necessarily drawn to scale, and wherein:

FIG. 1 illustrates a perspective view of an example of the presently disclosed multipurpose table in the "table mode" configuration and with the drop leaves open;

FIG. 2, FIG. 3, and FIG. 4 illustrate an end view, a side view, and a top down view, respectively, of the presently disclosed multipurpose table in the "table mode" configuration and with the drop leaves open;

FIG. 5 illustrates a side view of a portion of the presently disclosed multipurpose table showing the seat support installed in one of the openings in the base when the multipurpose table is in the "table mode" configuration;

FIG. 6 illustrates a perspective view of a portion of the base of the presently disclosed multipurpose table showing an example of the openings for receiving the seats thereof;

FIG. 7 illustrates a side view of a portion of the presently disclosed multipurpose table showing the seat support installed in one of the openings in the base when the multipurpose table is in the "table mode" configuration;

FIG. 8 illustrates a perspective view of an example of the presently disclosed multipurpose table in the "table mode" configuration and with the drop leaves closed;

FIG. 9 illustrates a perspective view of an example of the presently disclosed multipurpose table in the "bar mode" configuration;

FIG. 10, FIG. 11 and FIG. 12 illustrate an end view, a side view, and a top down view, respectively, of the presently disclosed multipurpose table in the "bar mode" configuration;

FIG. 13 illustrates a side view of a portion of the presently disclosed multipurpose table showing the seat support installed in one of the openings in the base when the multipurpose table is in the "bar mode" configuration;

FIG. 14 illustrates a perspective view of a portion of the tabletop assembly of the presently disclosed multipurpose table showing an example of the drop leaf latch thereof;

FIG. 15 illustrates a side view of the presently disclosed multipurpose table when anchored to a surface;

FIG. 16 illustrates a flow diagram of an example of a method of configuring the presently disclosed multipurpose table in the "table mode" of operation; and FIG. 17 illustrates a flow diagram of an example of a method of configuring the presently disclosed multipurpose table in the "bar mode" of operation.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a multipurpose table and methods of configuring the same. Namely, the multipurpose table can be configured in (1) a "table mode" of operation, (2) a "bar mode" of operation, and/or (3) a combination of both the "table mode" and "bar mode" of operation.

The multipurpose table comprises a base, or optionally a surface, such as a deck surface suitable for supporting the table, a pair of tabletop supports, a tabletop assembly, and a plurality of seats. The plurality of seats can be arranged outwardly from the tabletop assembly to provide the "table mode" of operation or arranged inwardly toward the tabletop assembly to provide the "bar mode" of operation. Further, some seats can be arranged outwardly from the tabletop assembly while at the same time other seats can be arranged inwardly toward the tabletop assembly. Further, the tabletop assembly includes a pair of drop leaves that can be opened or closed at the user's discretion.

When in the "bar mode" configuration, the multipurpose table provides a smaller footprint than, for example, a conventional multipurpose table, thereby minimizing the amount of space taken up by the multipurpose table, for example, when not in use or when in storage. Further, the overall dimensions of the presently disclosed multipurpose table make it amenable for use in small areas, including, but not limited to a small room, a deck, a patio, or a balcony. The appearance of the presently disclosed multipurpose table also is aesthetically pleasing.

Referring now to FIG. 1 is a perspective view of an embodiment of a multipurpose table 100 in the "table mode" configuration and with the drop leaves open, and also referring now to FIG. 2, FIG. 3, and FIG. 4 are an end view, a side view, and a top down view, respectively, of the multipurpose table 100 shown in FIG. 1. In this example, multipurpose table 100 comprises a base 110, a pair of tabletop supports 112, a tabletop assembly 114, and a plurality of seats 116. In this example, the multipurpose table 100 includes six seats 116 (e.g., seats 116A, 116B, 116C, 116D, 116E, and 116F). Multipurpose table 100, however, is not limited to six seats 116; this embodiment is exemplary only. The multipurpose table 100 can include any number of seats 116 and its size, e.g., a length suitable to accommodate the number of seats, can vary accordingly.

The multipurpose table 100 can be formed of any strong and durable material that is suitable for indoor or outdoor use and that is suitable for supporting the weight of people sitting on the seats 116. For example, the base 110, the tabletop supports 112, the tabletop assembly 114, and the seats 116 of the multipurpose table 100 can be formed of preservative-treated wood, untreated wood, including, but not limited to, oak, teak, maple, and the like, wood composite, plastic, fiberglass, metal, including, but not limited to, aluminum, stainless steel, galvanized steel, and the like, or any combinations thereof. For the purpose of a non-limiting illustration only, in the description to follow, the multipurpose table 100 is a wooden multipurpose table.

In some embodiments, the base 110 is, for example, a hollow, elongated, box-like structure that has a length, a width, and a height. The length of the base 110 is from about 24 inches to as long as the space in which the table is placed can accommodate. In particular embodiments, the length of the base 110 is about 84 inches. The width of the base 110 is from about 19 inches to as wide as the space in which the table is placed can accommodate. In particular embodiments, the width of base 110 is about 19 inches. The height of the base 110 is from about 9 inches to about 12 inches. In particular embodiments, the height of the base 110 is about 12 inches. Further, in the case of a wooden base 110, the thickness of the wood forming the base 110 is from about 1 inch to about 3 inches in one example, or is about 1.5 inches in another example. Additionally, inside the base 110 may be other supporting structures that are not visible in FIG. 1, FIG. 2, FIG. 3, and FIG. 4. Such additional supporting structures can add to the thickness of the wood forming the base 110.

Further, in some embodiments, the base 110 includes a set of openings 118 for receiving the seats 116. In one example, the base 110 includes six openings 118 (e.g., openings 118A, 118B, 118C, 118D, 118E, 118F) for receiving the six seats 116 (e.g., seats 116A, 116B, 116C, 116D, 116E, 116F), respectively. More details of the openings 118 in the base 110 are shown and described with reference to FIG. 6. More details of the seats 116 fitted into the openings 118 are shown and described with reference to FIG. 7 and FIG. 13.

In an alternative embodiment, the multipurpose table 100 does not include base 110, and the multipurpose table 100 is supported on a surface, such as a deck surface, in which an area immediately below the surface is open and the surface further includes a set of openings 118 for receiving the seats 116. In this configuration, the surface, e.g., a deck surface, functions as the base 110. Accordingly, the term "base" as used herein also can refer to a supporting surface, such as a deck surface.

The two tabletop supports 112 are arranged substantially orthogonal to an upper surface of the base 110. For example, a tabletop support 112A is arranged in orthogonal fashion at one end of the base 110 and a tabletop support 112B is arranged in orthogonal fashion at an opposite end of the base 110. The two tabletop supports 112 are, for example, solid, elongated, wooden supports. In particular embodiments, the length of the tabletop supports 112 is about 28 inches. The tabletop supports 112 have, for example, a square, rectangular, or circular cross-section. In one example, the square cross-section of tabletop supports 112 is about 4×4 inches. In another example, the square cross-section of tabletop supports 112 is about 6×6 inches.

The upper ends of the two tabletop supports 112 support the tabletop assembly 114. The tabletop assembly 114 comprises, for example, a center panel 120 that is flanked by two drop leaves 122 (e.g., a drop leaf 122A and a drop leaf 122B). The two drop leaves 122 can be folded under the center panel 120 (hereafter called the "closed position") or folded out away from the center panel 120 (hereafter called the "opened position") via a respective set of hinges 124 (see FIG. 8 and FIG. 10). FIG. 1 shows the two drop leaves 122 in the opened position for providing the maximum table surface area.

The thickness of the center panel 120 and the two drop leaves 122 can be from about 1 inch to about 2 inches in one example, or is about 1.5 inches in another example. In one example, the center panel 120 is about 84 inches long by about 19 inches wide. In one example, each of the two drop leaves 122 is about 84 inches long by about 4.75 inches wide. In this example, the tabletop surface area when the two drop leaves 122 are opened is about 84 inches by about 28.5 inches. In this example, the tabletop surface area when the two drop leaves 122 are closed is about 84 inches by about 19 inches.

The two drop leaves 122 can be held in the opened position via a set of drop leaf supports 126. For example, FIG. 1 shows four drop leaf supports 126 (e.g., drop leaf supports 126A, 126B, 126C, 126D), whereas the drop leaf supports 126A and 126B are attached to opposing sides of tabletop support 112A and the drop leaf supports 126C and 126D are attached to opposing sides of tabletop support 112B. In one example, the drop leaf supports 126 are triangular-shaped. Each of the drop leaf supports 126 is coupled to its respective tabletop support 112 via hinges 127. The drop leaf supports 126 can be folded out away from the tabletop supports 112 to hold the two drop leaves 122 in the opened position. Namely, drop leaf supports 126A and 126C are used to the hold drop leaf 122A in the opened position. Drop leaf supports 126B and 126D are used to hold the drop leaf 122B in the opened position.

By contrast, the drop leaf supports 126 can be folded in toward the tabletop supports 112 to allow the two drop leaves 122 to be in the closed position (see FIG. 8). Drop leaf 122A and drop leaf 122B can be opened and closed independently. The two drop leaves 122 can be held in the closed position via a drop leaf latch 128. More details of the drop leaf latch 128 are shown and described with reference to FIG. 14.

Optionally, the tabletop assembly 114 of the multipurpose table 100 further includes a pair of end panels 129. For example, an end panel 129A is provided at one end of the tabletop assembly 114 and an end panel 129B is provided at the opposite end of the tabletop assembly 114. The end panels 129 are provided for aesthetic purposes.

The overall height of the multipurpose table 100, which includes the base 110, the tabletop supports 112, and the tabletop assembly 114, is from about 30 inches to about 42 inches in one example. In particular embodiments, e.g., in embodiments wherein the height of base 110 is about 12 inches, the overall height of the multipurpose table 100 is about 42 inches. In other embodiments, e.g., in embodiments without base 110 in which a surface functions as base 110, the overall height of the multipurpose table 100 is about 30 inches. In other words, the overall height of the multipurpose table 100 is about 30 inches from the top of the base 110 or, in embodiments without a base 110, about 30 inches from the surface of a deck structure. Further, when the multipurpose table 100 is in the "table mode" configuration, the overall width from seat-to-seat (outer edge) is, for example, about 54.5 inches.

One of ordinary skill in the art on review of the presently disclosed subject matter would appreciate that the dimensions of multipurpose table 100 can be varied based, in part, on space available to accommodate the table and personal preferences regarding seating comfort. For example, a typical height of a seat, e.g., a seat of an ordinary chair, is about 18 inches. Further, a typical height of a table top is about 30 inches. If a base, e.g., base 110, is added to the table, then the height of the table top and seat is raised by the height of the base 110. For example, if base 110 has a height of about 12 inches, then the height of the seat will be about 30 inches and the height of the table top will be about 42 inches, as provided in the example disclosed immediately hereinabove. In an alternative embodiment, if base 110 has a height of about 9 inches, then the height of the seat will be about 27 inches and the height of the table top will be about 39 inches.

Further, one of ordinary skill in the art would appreciate that the dimensions of the multipurpose table 100 can be varied proportionally such that the functionality and seating comfort of the table is preserved, e.g., so that the multipurpose table 100 can be operated in the "table mode" or "bar mode" configurations, the drop leaves 122 can be in the "closed position" or the "open position," and the seats 116 can fit underneath the tabletop assembly 114 in the "bar mode" configuration, as disclosed herein below.

Referring still to FIG. 1, FIG. 2, FIG. 3, and FIG. 4, and now also referring to FIG. 5, which is a perspective view of an example of one seat 116 of the multipurpose table 100, each of the seats 116 includes a seat support 130 that has a first end 132 and a second end 134. The first end 132 of the seat support 130 is designed to hold a seat top 136. The second end 134 of the seat support 130 is designed to be fitted into one of the openings 118 in the base 110. The seat top 136 can be any footprint that is suitable for sitting on, such as rectangular, square, circular, ovular, hexagonal, and octagonal, and the like. In one example, the overall dimension of the seat top 130 is about 12 inches by about 11.25 inches, which can vary by about one inch, or about two inches, or more in any dimension.

Because the seat top 136 is affixed to the first end 132 of the seat support 130, the first end 132 is cut at an angle $\alpha$ to provide a comfortable sitting angle when in use in the "table mode" of operation. A wedge support 138 is provided between the seat top 136 and the side of the seat support 130, as shown in FIG. 5. Additionally, seat support 130 comprises two notches; namely, a first notch 140 and a second notch 142 are provided toward the second end 134 the seat support 130, as shown in FIG. 5. The first notch 140 and the second notch 142 provide locking features for holding securely the seat support 130 in an opening 118 in the base 110. The second end 134 of the seat support 130 can be either angle-cut (as shown) or square-cut.

The length of the seat support 130 (on its longest side), in particular embodiments, is about 32 inches, including the section of the seat support 130 that is fitted into the base 110. The seat support 130 has a square or rectangular cross-section. The cross-section of the seat support 130 is about 4×4 inches in one example, or is about 3.5×3.5 inches in another example. Because the seat support 130 is designed to be fitted into one of the openings 118 in the base 110, then each of the openings 118 must be slightly larger than the cross-sectional dimension of the seat support 130.

FIG. 6 illustrates a perspective view of a portion of the base 110 of the multipurpose table 100 showing an example of the openings 118 for receiving the seats 116. In one example, for a 4×4 inch-seat support 130, the width W of the opening 118 is about 4.125 inches and the length L of the opening 118 is about 5.5 inches. In another example, for a 3.5×3.5 inch-seat support 130, the width W of the opening 118 is about 3.625 inches and the length L of the opening 118 is about 5 inches.

Referring now to FIG. 7, a side view of a portion of the multipurpose table 100 is presented showing the seat support 130 installed in one of the openings 118 in the base 110 when the multipurpose table 100 is in the "table mode" configuration. The seat support 130 is set at an angle $\theta$ with respect to the upper surface of the base 110. In the "table mode" configuration, angle $\theta$, in particular embodiments, can be from about 40 degrees to about 50 degrees, including 40, 41, 42, 43, 44, 45, 46, 47, 48, 49, and 50 degrees and any partial degree increment thereof. In particular embodiments, angle $\theta$ is about 45 degrees. One of ordinary skill in the art would recognize that angle $\theta$ can vary with the relative dimensions of the other components of the multipurpose table 100. In the "table mode" configuration, the first notch 140 is engaged with the outside surface of the base 110, while the second notch 142 is engaged with the inside surface of the base 110, as shown. The inside surface of the base 110 can, in some embodiments, further comprise an additional support 119, e.g., an additional support having a width of about 2 inches and a thickness of about 1.5 inches. Accordingly, in such embodiments, the thickness of the inside surface of the base 110 in combination with the additional support 119 can be about 3 inches. In such embodiments, second notch 142 is adapted to engage with the inside surface of the base 110 in combination with the additional support 119 for locking and holding securely the seat support 130. To provide the proper sitting angle at seat top 136, angle $\alpha$ at the first end 132 of the seat support 130 is substantially the same as angle $\theta$. For example, if angle $\theta$ is about 45 degrees, then angle $\alpha$ is also about 45 degrees.

FIG. 8 illustrates a perspective view of an example of the presently disclosed multipurpose table 100 in the "table mode" configuration and with the drop leaves 122 closed. In one example, the tabletop surface area when the two drop leaves 122 are closed is about 84 inches by about 19 inches. The two drop leaves 122 in the closed position also support the "bar mode" configuration. In another example, one drop leaf 122 can be opened and the other drop leaf 122 can be closed.

Referring now to FIG. 9 is a perspective view of the multipurpose table 100 in the "bar mode" configuration, and also referring now to FIG. 10, FIG. 11 and FIG. 12 are an end view, a side view, and a top down view, respectively, of the multipurpose table 100 shown in FIG. 9. In this example of the "bar mode" configuration, the drop leaves 122 are closed. In the "bar mode" configuration, however, the drop leaves 122 optionally can be opened. That is, the "bar mode" configuration refers mainly to the position of the seats 116 that allows a user to stand at the tabletop assembly 114 rather than to sit at the tabletop assembly 114. Namely, in the "bar mode" configuration, the seats 116 are arranged inward toward and underneath the tabletop assembly 114, as shown in FIG. 9, FIG. 10, FIG. 11 and FIG. 12.

Further, in some embodiments, in the "bar mode" configuration, as shown in FIG. 10, the seats 116, when arranged inward toward and underneath the tabletop assembly 114, extend from a distance x' from tabletop support 112A equal to an outermost edge of tabletop assembly 114 when the drop leaves 122 are closed. This feature allows the space required for the table in the "bar mode" configuration to be minimized.

Additionally, FIG. 13 illustrates a side view of a portion of the multipurpose table 100 showing the seat support 130 installed in one of the openings 118 in the base 110 when the multipurpose table 100 is in the "bar mode" configuration. In the "bar mode" configuration, the angle θ of the seat support 130 with respect to the upper surface of the base 110 is, for example, about 90 degrees. In this position, the first notch 140 and the second notch 142 are not engaged with the base 110 and the seat support 130 rests by gravity within the opening 118, with its second end 134 against the inside bottom of the base 110, as shown in FIG. 13.

FIG. 14 illustrates a perspective view of a portion of the tabletop assembly 114 of the multipurpose table 100 showing an example of the drop leaf latch 128. In this example, the drop leaf latch 128 includes two slider bars 144; one for each of the drop leaves 122. Namely, the drop leaf latch 128 includes a slider bar 144A for holding the drop leaf 122A in the closed position and a slider bar 144B for holding the drop leaf 122B in the closed position. Slider bar 144A and 144B can be operated independently.

FIG. 15 illustrates a side view of the presently disclosed multipurpose table 100 when anchored to a surface. In one example, the base 110 of the multipurpose table 100 is anchored to a concrete slab. In this example, multiple concrete bolts 150 may pass at an angle from the inside to the outside of the base 110 and are anchored into the concrete slab. For example, two concrete bolts 150 may be used at one end of the base 110 and two concrete bolts 150 may be used at the other end of the base 110. In another example, the base 110 of the multipurpose table 100 is anchored to a wooden deck. In this example, multiple lag bolts (not shown) may pass at an angle from the inside to the outside of the base 110 and are anchored into the wooden deck.

Referring again to FIG. 1 through FIG. 15, the presently disclosed multipurpose table 100 is not limited to six seats 116 (e.g., seats 116A, 116B, 116C, 116D, 116E, and 116F). The multipurpose table 100 can include any number of seats 116 and the size can vary accordingly. Further, preferably the corners or edges of the components of the multipurpose table 100 are smoothed or beveled so that they are smooth to the touch and, in the case of wood, without splinters. Additionally, in the case of a wooden multipurpose table 100, the multipurpose table 100 can be left unfinished, or optionally the multipurpose table 100 can be fully or in part painted and/or stained. Further, the footprint of the base 110 and the tabletop assembly 114 is not limited to rectangular. The base 110 and the tabletop assembly 114 of the multipurpose table 100 can be any footprint that allows a plurality of seats 116 to be arranged around the tabletop assembly 114. For example, the footprint of the base 110 and the tabletop assembly 114 can be rectangular, square, circular, ovular, hexagonal, octagonal, and the like.

FIG. 16 illustrates a flow diagram of an example of a method 1600 of configuring the presently disclosed multipurpose table 100 in the "table mode" of operation. Namely, the starting point of method 1600 is the multipurpose table 100 in the "bar mode" configuration, such as shown in FIG. 9, and the ending point of method 1600 is the multipurpose table 100 in the "table mode" configuration, such as shown in FIG. 1. Method 1600 may include, but is not limited to, the following steps.

At a step 1610, the user lifts upward on the first seat 116 (e.g., seat 116A) and at the same time moves the seat top 136 away from the tabletop assembly 114 of the multipurpose table 100. All the while, the second end 134 of the seat support 130 of the first seat 116 (e.g., seat 116A) is maintained within the first opening 118 (e.g., opening 118A) in the base 110 of the multipurpose table 100. Method 1600 proceeds to a step 1615.

At step 1615, the user engages the first notch 140 and the second notch 142 of the seat support 130 of the first seat 116 (e.g., seat 116A) with the edges of the first opening 118 (e.g., opening 118A) in the base 110 of the multipurpose table 100, as shown in FIG. 7. Method 1600 proceeds to a step 1620.

At decision step 1620, it is determined whether there is another seat 116 of the multipurpose table 100 to be configured for use in the "table mode" of operation. If yes, then method 1600 proceeds to a step 1625. If no, however, then method 1600 proceeds to a step 1635.

At step 1625, the user lifts upward on the next seat 116 (e.g., seat 116B, 116C, 116D, 116E, or 116F) and at the same time moves the seat top 136 away from the tabletop assembly 114 of the multipurpose table 100. All the while, the seat support 130 of the next seat 116 (e.g., seat 116B, 116C, 116D, 116E, or 116F) is maintained within the next opening 118 (e.g., opening 118B, 118C, 118D, 118E, or 118F) in the base 110 of the multipurpose table 100. Method 1600 proceeds to a step 1630.

At step 1630, the user engages the first notch 140 and the second notch 142 of the seat support 130 of the next seat 116 (e.g., seat 116B, 116C, 116D, 116E, or 116F) with the edges of the next opening 118 (e.g., opening 118B, 118C, 118D, 118E, or 118F) in the base 110 of the multipurpose table 100, as shown in FIG. 7. Method 1600 returns to step 1620.

At step 1635, by manipulating the drop leaf latch 128 and the drop leaf supports 126, the user opens or closes one or both of the drop leaves 122 as desired, the configuring is complete and method 1600 ends.

FIG. 17 illustrates a flow diagram of an example of a method 1700 of configuring the presently disclosed multipurpose table 100 in the "bar mode" of operation. Namely, the starting point of method 1700 is the multipurpose table 100 in the "table mode" configuration, such as shown in FIG. 1, and the ending point of method 1700 is the multipurpose table 100 in the "bar mode" configuration, such as shown in FIG. 9. Method 1700 may include, but is not limited to, the following steps.

At a step 1710, the user pushes the seat top 136 of the first seat 116 (e.g., seat 116A) toward the tabletop assembly 114 of the multipurpose table 100. All the while, the second end 134 of the seat support 130 of the first seat 116 (e.g., seat 116A) is maintained within the first opening 118 (e.g., opening 118A) in the base 110 of the multipurpose table 100. Method 1700 proceeds to a step 1715.

At step 1715, as the first notch 140 and the second notch 142 disengage from the edges of the first opening 118 (e.g., opening 118A) in the base 110 of the multipurpose table 100, the user guides the seat support 130 of the first seat 116 (e.g., seat 116A) to fall by gravity into the base 110, as shown in FIG. 13. Method 1700 proceeds to a step 1720.

At decision step 1720, it is determined whether there is another seat 116 of the multipurpose table 100 to be configured for use in the "bar mode" of operation. If yes, then method 1700 proceeds to a step 1725. If no, however, then method 1700 proceeds to a step 1735.

At step 1725, the user pushes the seat top 136 of the next seat 116 (e.g., seat 116B, 116C, 116D, 116E, or 116F) toward the tabletop assembly 114 of the multipurpose table 100. All the while, the second end 134 of the seat support 130 of the next seat 116 (e.g., seat 116B, 116C, 116D, 116E, or 116F) is maintained within the next opening 118 (e.g., opening 118B, 118C, 118D, 118E, or 118F) in the base 110 of the multipurpose table 100. Method 1700 proceeds to a step 1730.

At step 1730, as the first notch 140 and the second notch 142 disengage from the edges of the next opening 118 (e.g., opening 118B, 118C, 118D, 118E, or 118F) in the base 110 of the multipurpose table 100, the user guides the seat support 130 of the next seat 116 (e.g., seat 116B, 116C, 116D, 116E, or 116F) to fall by gravity into the base 110, as shown in FIG. 13. Method 1700 returns to step 1720.

At step 1735, by manipulating the drop leaf latch 128 and the drop leaf supports 126, the user opens or closes one or both of the drop leaves 122 as desired, the configuring is complete and method 1700 ends.

Referring again to method 1600 of FIG. 16 and method 1700 of FIG. 17, the presently disclosed multipurpose table 100 is not limited to being fully in the "table mode" configuration or fully in the "bar mode" configuration. Namely, one or more of the seats 116 can be positioned in the "table mode" configuration at the same time that one or more other seats 116 are positioned in the "bar mode" configuration, and in any combinations. Using the example shown in FIG. 1 and FIG. 9 of six seats 116, any one seat 116 can be in the "table mode" configuration while the remaining five seats 116 are in the "bar mode" configuration, any two seats 116 can be in the "table mode" configuration while the remaining four seats 116 are in the "bar mode" configuration, any three seats 116 can be in the "table mode" configuration while the remaining three seats 116 are in the "bar mode" configuration, any four seats 116 can be in the "table mode" configuration while the remaining two seats 116 are in the "bar mode" configuration, and any five seats 116 can be in the "table mode" configuration while the remaining one seat 116 is in the "bar mode" configuration.

In one example and referring again to FIG. 1 and FIG. 9, the three seats 116 on one side of the multipurpose table 100 (e.g., seats 116A, 116B, and 116C) can be in the "table mode" configuration while the three seats 116 on the other side of the multipurpose table 100 (e.g., seats 116D, 116E, and 116F) are in the "bar mode" configuration. In another example, two seats 116 on one end of the multipurpose table 100 (e.g., seats 116A and 116D) can be in the "table mode" configuration while the remaining four seats 116 on the other end of the multipurpose table 100 (e.g., seats 116B, 116C, 116E, and 116F) are in the "bar mode" configuration.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A multipurpose table comprising:

a base, or optionally a surface, comprising one or more openings, wherein the one or more openings has a cross-sectional dimension greater than a cross-sectional dimension of one or more seat supports, and wherein each seat support comprises a first end and a second end, wherein the first end has a seat top affixed thereto and the second end is adapted to fit into at least one of the one or more openings in the base, and wherein each seat support has a first notch on one side thereof and a second notch on an opposite side thereof, wherein each notch is positioned toward the second end of the seat support, wherein the first notch is nearer the first end in relation to the second notch and is configured to be engaged with an edge of the outside surface of the base and the second notch is nearer the second end in relation to the first notch and is configured to be engaged with an edge of the inside surface of the base to securely hold the seat support in a predetermined position;

a tabletop assembly comprising a center panel having at least two opposing sides, wherein at least one opposing side has a drop leaf foldably coupled thereto; and at least one tabletop support, wherein the at least one tabletop support is mechanically coupled at one end to an upper surface of the base and at an opposite end to a lower surface of the tabletop, wherein the at least one tabletop support is arranged substantially orthogonal with respect to a plane extending parallel to the upper surface of the base;

and wherein the at least one tabletop support further comprises a set of drop leaf supports foldably coupled thereto and configured to be folded away from the tabletop support to engage a drop leaf and hold it in an open position and configured to be folded in toward the tabletop support when the drop leaf is in a closed position.

2. The multipurpose table of claim 1, wherein the one or more openings in the base comprise a number equal to a number of the one or more seat supports.

3. The multipurpose table of claim 1, comprising between two and eight seat supports, wherein each seat support has a seat top affixed thereto.

4. The multipurpose table of claim 1, comprising at least two tabletop supports, wherein a first tabletop support is arranged substantially orthogonal with respect to a plane extending parallel to an upper surface of the base at one end of the base and a second tabletop is arranged substantially orthogonal with respect to a plane extending parallel to an upper surface of the base at an opposite end of the base.

5. The multipurpose table of claim 1, wherein each drop leaf is foldably attached to at least one opposing side by a hinge.

6. The multipurpose table of claim 1, wherein each drop leaf can be independently folded under the center panel in a closed position and/or folded away from the center panel in an open position.

7. The multipurpose table of claim 1, further comprising a drop leaf latch, wherein the drop leaf latch comprises a slider bar for engaging the drop leaf and holding the drop leaf in a closed position.

8. The multipurpose table of claim 1, wherein each drop leaf support is foldably coupled to at least one tabletop support by a hinge.

9. The multipurpose table of claim 1, wherein the tabletop assembly has a geometry selected from the group consisting of rectangular, square, circular, ovular, hexagonal, and octagonal.

10. The multipurpose table of claim 1, wherein the tabletop assembly further comprises a pair of end panels, wherein a first end panel is mechanically attached to one end of the tabletop assembly and a second end panel is mechanically attached to an opposite end of the tabletop assembly.

11. The multipurpose table of claim 1, wherein the seat top has a geometry selected from the group consisting of rectangular, square, circular, ovular, hexagonal, and octagonal.

12. The multipurpose table of claim 1, wherein the first end of the one or more seat supports is adapted to have an angle $\alpha$ such that the seat top affixed thereto provides a comfortable sitting angle with respect to a plane extending parallel to a side of the seat support having a second notch positioned thereon.

13. The multipurpose table of claim 1, further comprising a wedge support positioned proximate the first end of the seat support having a seat top affixed thereto between an underside of the seat top and a side of the support having a second notch positioned thereon.

14. The multipurpose table of claim 1, wherein the first notch of the one or more seat supports is engaged with an outside surface of the base, the second notch of the one or more seat supports is engaged with an inside surface of the base, and the one or more seat supports is set at an angle $\theta$ with respect to a plane extending parallel to an upper surface of the base.

15. The multipurpose table of claim 14, wherein the at least one seat support is set at angle $\theta$ of about 45 degrees with respect to the plane extending parallel to the upper surface of the base.

16. The multipurpose table of claim 15, wherein the first end of the one or more seat supports is adapted to have an angle $\alpha$ of about 45 degrees.

17. The multipurpose table of claim 14, wherein the angle $\theta$ of the one or more seat supports with respect to the plane extending parallel to the upper surface of the base is about 90 degrees.

18. The multipurpose table of claim 1, further comprising anchoring the multipurpose table to a surface by passing one or more bolts at an angle from the inside to the outside of the base and into the surface.

19. The multipurpose table of claim 1, wherein one or more of the base, the at least one tabletop support, the tabletop assembly, the one or more seat supports, and the seat top comprises a material selected from the group consisting of treated wood, untreated wood, wood composite, plastic, fiberglass, metal, and combinations thereof.

* * * * *